US006886504B2

(12) United States Patent
Johnstone

(10) Patent No.: US 6,886,504 B2
(45) Date of Patent: May 3, 2005

(54) ENGINE OF RECIPROCATING PISTON TYPE

(75) Inventor: Ian David Johnstone, Sussex (GB)

(73) Assignee: Ricardo Consulting Engineers Limited, West Sussex (GB)

( * ) Notice: Subject to any disclaimer, the term of this patent is extended or adjusted under 35 U.S.C. 154(b) by 0 days.

(21) Appl. No.: 10/490,878

(22) PCT Filed: Oct. 3, 2002

(86) PCT No.: PCT/GB02/04471

§ 371 (c)(1),
(2), (4) Date: Mar. 26, 2004

(87) PCT Pub. No.: WO03/029638

PCT Pub. Date: Apr. 10, 2003

(65) Prior Publication Data

US 2004/0182352 A1 Sep. 23, 2004

(30) Foreign Application Priority Data

Oct. 4, 2001 (GB) ..... 0123854

(51) Int. Cl.[7] ..... F01P 3/04

(52) U.S. Cl. ..... 123/41.52; 123/41.61; 123/193.1; 123/41.79

(58) Field of Search ..... 123/41.52, 41.61, 123/193.1, 193.2, 660, 41.79, 41.84

(56) References Cited

U.S. PATENT DOCUMENTS 5,749,331 A * 5/1998 Pettersson et al. ..... 123/193.2
6,123,052 A * 9/2000 Jahn ..... 123/41.79

FOREIGN PATENT DOCUMENTS

| | | |
|---|---|---|
| DE | 42 26 743 | 2/1994 |
| EP | 0 911 509 | 4/1999 |
| GB | 601 894 | 5/1948 |
| GB | 900 294 | 7/1962 |
| JP | 58-013256 | 1/1983 |

* cited by examiner

*Primary Examiner*—Bibhu Mohanty
(74) *Attorney, Agent, or Firm*—Reed Smith LLP

(57) ABSTRACT

An engine of reciprocating piston type includes a cylinder block (4) with one or more cylinders (2), each of which receives a respective piston (10) and is defined by a respective cylinder barrel (8), which is integral with the reminder of the cylinder block. The outer surface of each cylinder barrel (8) carries a plurality of substantially circumferential discontinuous reinforcing ribs, each comprising a plurality of elongate projections (12) spaced apart by gaps (14). Each projection (12) in each rib is in registry with a gap in the or each adjacent rib, when viewed in the direction of the length of the associated cylinder barrel.

20 Claims, 1 Drawing Sheet

ENGINE OF RECIPROCATING PISTON TYPE

CROSS-REFERENCE TO RELATED APPLICATIONS

This application claims priority of International Application No. PCT/GB02/04471, filed Oct. 3, 2002 and British Application No. 012 38 54.2, filed Oct. 4, 2001, the complete disclosures of which are hereby incorporated by reference.

BACKGROUND OF THE INVENTION

The present invention relates to internal combustion engines of reciprocating piston type, particularly though not exclusively of closed deck diesel type, and is concerned with the cylinder block and more specifically the cylinder barrels of such engines. Engines of closed deck type are those in which the cylinder barrels are integral with the remainder of the block at both ends, whereby the upper surface of the block is substantially smooth and continuous apart from the openings constituted by the cylinders, for reason of economy of manufacture. The invention is specifically concerned with such engines of so-called parent bore type, that is to say engines in which the internal surfaces of the cylinders are afforded by members integral with the remainder of the cylinder block, whereby the cylinders have no steel liners or the like. Thus, the invention relates to an engine of reciprocating piston type including a cylinder block which includes one or more cylinders, each of which reciprocally receives a respective piston and is defined by a respective cylinder barrel, which is integral with the remainder of the cylinder block.

The current tendency in diesel engine design is to use ever-increasing maximum pressures within the cylinders. There is also a commercial requirement to use lighter and cheaper metals for the cylinder block, that is to say, e.g. aluminium rather than steel.

The pressure caused by combustion of the fuel/air mixture exerts very substantial forces on the internal surfaces of the cylinder barrels, particularly on the upper portions thereof where the pressure is greatest. This pressure tends to cause the cylinder barrels to deform outwardly and in extreme cases even to crack or burst. This deformation results in an increase in "blow-by", that is to say passage of combustion gases past the piston into the lower portions of the cylinder barrels and an increase in oil "carry-over", that is to say in the volume of oil which flows past the piston rings into the combustion space and then in an increase in the oil consumption of, and smoke emission from, the engine.

All of these problems are becoming increasingly more severe as a result of the design trends referred to above, namely the trend to use lighter metals for the cylinder block and barrels, the trend towards higher cylinder pressures and the trend towards open deck type cylinder blocks.

It is of course known that these problems may be overcome by providing cylinder liners of tougher more rigid material, e.g. of steel, but the engine is not then of parent bore type and it is not desirable to provide such liners because of the additional manufacturing complexity and expense and the consequent increase in the length of the cylinder block.

In order to counteract the problems referred to above it is known to be desirable to make the cylinder barrels as thick as possible so as to make them as stiff as possible and thus better able to resist the internal pressures to which they are subjected and thus less subject to distortion.

However, in order to maximise the durability of the pistons and to improve the combustion characteristics, it is known to be desirable to make the cylinder barrels as thin as possible so as to maximise the rate of heat transfer from the internal surfaces of the cylinder barrels to the cooling water surrounding them. It is also desirable to make them thin from the point of view of reducing the engine weight.

These two conflicting requirements have always meant in practice that the thickness of the walls of the cylinder barrels has always been seen as a compromise and this thickness is typically of the order of 7% of the cylinder bore diameter.

EP 0911509 relates to a not dissimilar problem, namely the problem resulting from distortion of the cylinder barrels caused by the loads applied to them by the bolts which clamp the cylinder head to the cylinder block. The answer to that problem is said in the prior specification to be to increase the stiffness of the cylinder barrels by providing circumferentially spaced axially extending stiffening ribs on the exterior of the cylinder barrels. The forces acting on the cylinder barrels as a result of the internal pressure do of course act in a different direction to those caused by the action of the clamping bolts and it might be thought that a similar solution could be adapted by providing a plurality of circumferential ribs around the outer surface of the cylinder barrels in the manner of barrel hoops. These ribs would be stressed in tension by the pressure within the cylinders and would enable the cylinder barrels to withstand that pressure.

However, in the prior document, four reinforcing ribs are provided on each cylinder barrel which extend over only about the upper one third of their height. The additional mass and reduction in the thermal conductivity of the cylinder barrels is therefore negligible. A circumferential rib on the other hand is inherently relatively long and it is found that the provision of a plurality of such long ribs increases the mass and decreases the thermal conductivity of the cylinder barrels to an unacceptable extent.

It is, therefore, the object of the invention to provide an engine of the type referred to above in which the cylinder barrels are better able to withstand the high internal pressures to which they are subjected but nevertheless are not significantly heavier than usual and do not have a significantly degraded thermal conductivity.

According to the present invention, an engine of the type referred to above is characterised in that the outer surface of each cylinder barrel carries a plurality of substantially circumferential reinforcing ribs, each rib comprising a plurality of elongate projections spaced apart by gaps, each projection in each rib being in registry with a gap in the or each adjacent rib, when viewed in the direction of the length of the associated cylinder barrel.

Thus in the engine in accordance with the present invention, the cylinder barrels are provided with a series of axially spaced, substantially circumferential reinforcing ribs. These ribs strengthen the cylinder barrel and enable it to resist the forces applied by the high pressure within the cylinder barrel during operation of the engine. Although the ribs add slightly to the mass of the cylinder barrel, this effect is extremely small. The locally increased thickness of the cylinder barrel tends to reduce heat transfer through the cylinder barrel to the engine coolant at the positions of the ribs but this effect is largely counteracted by the increased surface area presented by the surfaces of the ribs. Furthermore, the ribs are not continuous but constitute a series of elongate projections spaced apart by gaps. This results in a decrease in the increase in weight which would be caused if the ribs were continuous. Furthermore, the fact that the ribs are discontinuous means that their constituent projections also have end surfaces and these surfaces result in a further increase of the heat transfer area available between the cylinder barrels and the coolant which further reduces the slight negative effect of the ribs on the heat transfer through the cylinder barrels.

Although it might be thought that the provision of gaps in the ribs would result in the ribs being unable to fulfil their intended reinforcing function, it is found that this is in practice not the case and that the tensional stress induced in the ribs follows a zigzag path, that is to say the lines of force extend longitudinally through the projections and then axially through the cylinder barrel to the adjacent projections in the rib on one or both sides of it and then back again at the end of that rib. In order to ensure that this force transfer between adjacent ribs occurs effectively, it is preferred that the projections are longer than the gaps and that each projection overlaps wholly with a gap in the or each adjacent rib, when viewed in the direction of the length of the associated cylinder barrel.

The adjacent ribs may be truly circumferential, that is to say they may each lie in a plane which is perpendicular to the axis of the associated cylinder. However, they may also each be inclined by up to 45°, e.g. 5° to 25' and most preferably 15° to 20° to the circumferential direction with respect to the axis of the associated cylinder. In this case, the ribs may be wholly separate or alternatively they may be continuous and constitute a single spiral rib.

It will be appreciated that the pressure within the or each cylinder barrel is at a maximum when the piston is relatively close to the top dead centre position during the working stroke of the piston and progressively decreases as the piston moves towards the bottom dead centre position. This means that the portion of the cylinder barrel furthest from the crankshaft, to which the pistons are in practice connected by respective connecting rods, is exposed to pressures greater than portions of the cylinder barrels which are closer to the crankshaft. This means that the reinforcement required by the cylinder barrels progressively decreases in the direction towards the crankshaft and that no reinforcement at all may be required in that portion of the cylinder barrels closest to the crankshaft. The reinforcing ribs are therefore preferably provided only on that portion of the cylinder barrels furthest from the crankshaft, e.g. the upper third or half of each cylinder barrel and that the thickness in the radial direction of adjacent ribs in the axial direction, with respect to the axis of the associated cylinder, preferably decreases progressively in the direction towards the crankshaft.

Further features and details of the invention will be apparent from the following description of one specific embodiment which is given by way of example, with reference to the accompanying drawings, in which:

DESCRIPTION OF THE PREFERRED EMBODIMENTS

Figure 1:
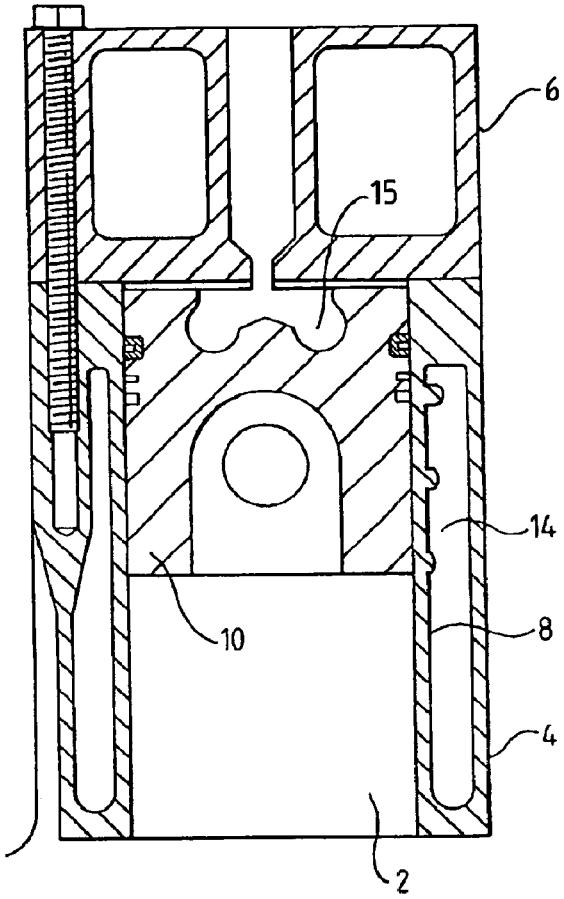
FIG. 1 is an axial sectional view on the line I—I in FIG. 3 of one cylinder and the associated piston of a multi-cylinder engine in accordance with the invention.
Figure 2:
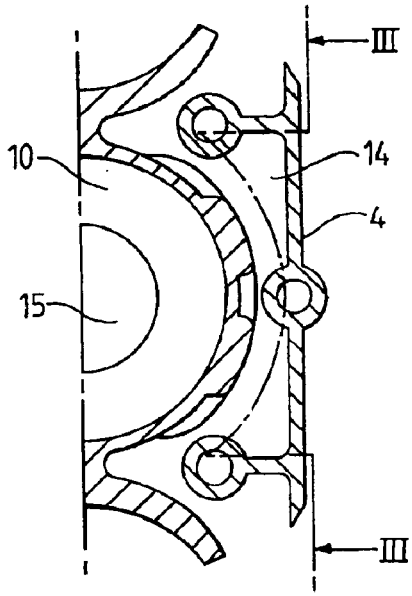
FIG. 2 is a transverse sectional view of one half of the cylinder shown in FIG. 1 with the piston at the bottom dead centre position.
Figure 3:
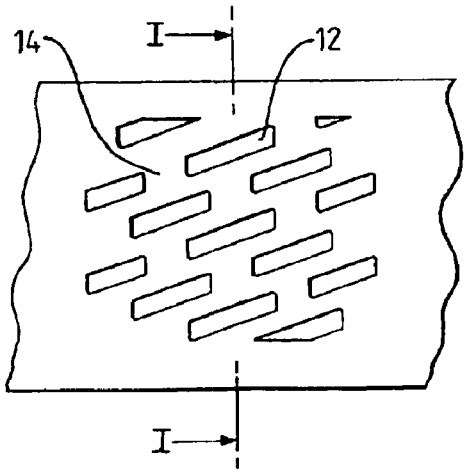
FIG. 3 is a scrap view of the portion of the cylinder barrel shown in FIGS. 1 and 2 seen along the line III—III in FIG. 2.

The engine shown in the drawings includes a plurality of cylinders 2 within a cylinder block 4, connected to which is a cylinder head 6. Each cylinder is defined by a respective cylinder barrel 8, which is integral with the cylinder block. The cylinder barrels do not contain liners or the like and the engine is therefore of parent bore type. Each cylinder contains a reciprocable piston 10, the pistons being connected by respective connecting rods (not shown) to a common crankshaft (also not shown). Defined in the upper surface of the piston 10 in this case is a recess 15 constituting a combustion chamber. Between each cylinder barrel 8 and the adjacent outer wall of the cylinder block 4 is a space 14 through which coolant, typically water based, is circulated, in use, in order to remove heat from and thus cool the cylinders.

In order to reinforce the upper portion of the cylinder barrel and to enable it adequately to resist the substantial forces to which it is subjected by the high pressure burning gases within it, each cylinder barrel is provided on the upper one third to one half of its outer surface with a plurality of axially spaced, substantially circumferential reinforcing ribs. Each rib is of substantially circular annular shape, when viewed in direction of the cylinder axis and whilst this annulus could extend in a plane perpendicular to the associated cylinder axis, it extends in this case at an angle of about 15° to the cylinder axis, that is to say to the circumferential direction. Each rib is discontinuous and constitutes a plurality of elongate projections 12 spaced apart by gaps 14. The projections 12 are longer than the gaps 14 in the circumferential direction, in this case about twice as long. In a typical example, each projection is about 30 mm long and 3 mm wide whereas the gaps are typically only about 15 mm long. Adjacent ribs are spaced apart in this specific example by about 3 to 8 mm in the axial direction. Since the internal pressure within the cylinders increases within increasing distance from the crankshaft, the rib furthest from the crankshaft has the greatest thickness, that is to say dimension in the radial direction and the ribs below it, that is to say closer to the crankshaft, have a progressively decreasing thickness. In a specific example, the thickest rib had a thickness of 4 mm whilst the thinnest rib, that is to say the rib closest to the crankshaft, had a thickness of only 1 mm.

What is claimed is:

1. An engine of reciprocating piston type including a cylinder block which includes one or more cylinders, each of which reciprocally receives a respective piston and is defined by a respective cylinder barrel which is integral with the remainder of the cylinder-block, the outer surface of each cylinder barrel carrying a plurality of substantially circumferential reinforcing ribs, each rib comprising a plurality of elongate projections spaced apart by gaps, each projection in each rib being in registry with a gap in the or each adjacent rib, when viewed in the direction of the length of the associated cylinder barrel.

2. An engine as claimed in claim 1 in which the projections are longer than the gaps and each projection overlaps totally with a gap in the or each adjacent rib, when viewed in the direction of the length of the associated cylinder barrel.

3. An engine as claimed in claim 1 in which each of said reinforcing ribs is inclined by an angle of between five degrees and twenty-five degrees to a circular circumferential plane.

4. An engine as claimed in claim 2 in which each of said reinforcing ribs is inclined by an angle of between five degrees and twenty-five degrees to a circular circumferential plane.

5. An engine as claimed in claim 3 in which each of said ribs are arranged with adjacent ribs to provide a spiral configuration.

6. An engine as claimed in claim 4 in which each of said ribs are arranged with adjacent ribs to provide a spiral configuration.

7. An engine as claimed in claim 1 in which the pistons are connected by respective connecting rods to a common crankshaft and the reinforcing ribs are provided only on that portion of the or each cylinder barrel furthest from the crankshaft.

8. An engine as claimed in claim 2 in which the pistons are connected by respective connecting rods to a common crankshaft and the reinforcing ribs are provided only on that portion of the or each cylinder barrel furthest from the crankshaft.

9. An engine as claimed in claim 3 in which the pistons are connected by respective connecting rods to a common crankshaft and the reinforcing ribs are provided only on that portion of the or each cylinder barrel furthest from the crankshaft.

10. An engine as claimed in claim 4 in which the pistons are connected by respective connecting rods to a common crankshaft and the reinforcing ribs are provided only on that portion of the or each cylinder barrel furthest from the crankshaft.

11. An engine as claimed in claim 1 in which the pistons are connected by respective connecting rods to a common crankshaft and the thickness in the radial direction adjacent ribs in axial direction with respect to the axis of the associated cylinder decreases progressively in the direction towards the crankshaft.

12. An engine as claimed in claim 2 in which the pistons are connected by respective connecting rods to a common crankshaft and the thickness in the radial direction adjacent ribs in axial direction with respect to the axis of the associated cylinder decreases progressively in the direction towards the crankshaft.

13. An engine as claimed in claim 3 in which the pistons are connected by respective connecting rods to a common crankshaft and the thickness in the radial direction adjacent ribs in axial direction with respect to the axis of the associated cylinder decreases progressively in the direction towards the crankshaft.

14. An engine as claimed in claim 4 in which the pistons are connected by respective connecting rods to a common crankshaft and the thickness in the radial direction adjacent ribs in axial direction with respect to the axis of the associated cylinder decreases progressively in the direction towards the crankshaft.

15. An engine as claimed in claim 5 in which the pistons are connected by respective connecting rods to a common crankshaft and the thickness in the radial direction adjacent ribs in axial direction with respect to the axis of the associated cylinder decreases progressively in the direction towards the crankshaft.

16. An engine as claimed in claim 6 in which the pistons are connected by respective connecting rods to a common crankshaft and the thickness in the radial direction adjacent ribs in axial direction with respect to the axis of the associated cylinder decreases progressively in the direction towards the crankshaft.

17. An engine as claimed in claim 7 in which the pistons are connected by respective connecting rods to a common crankshaft and the thickness in the radial direction adjacent ribs in axial direction with respect to the axis of the associated cylinder decreases progressively in the direction towards the crankshaft.

18. An engine as claimed in claim 8 in which the pistons are connected by respective connecting rods to a common crankshaft and the thickness in the radial direction adjacent ribs in axial direction with respect to the axis of the associated cylinder decreases progressively in the direction towards the crankshaft.

19. An engine as claimed in claim 9 in which the pistons are connected by respective connecting rods to a common crankshaft and the thickness in the radial direction adjacent ribs in axial direction with respect to the axis of the associated cylinder decreases progressively in the direction towards the crankshaft.

20. An engine as claimed in claim 10 in which the pistons are connected by respective connecting rods to a common crankshaft and the thickness in the radial direction adjacent ribs in axial direction with respect to the axis of the associated cylinder decreases progressively in the direction towards the crankshaft.

* * * * *